United States Patent [19]

Seyama

[11] Patent Number: 4,501,211

[45] Date of Patent: Feb. 26, 1985

[54] LOCK STITCH TYPE HAND SEWING MACHINE

[75] Inventor: Tuneo Seyama, Yono, Japan

[73] Assignee: Kabushiki Kaisha Niida Seisakusho, Sanjo, Japan

[21] Appl. No.: 431,571

[22] Filed: Sep. 30, 1982

[30] Foreign Application Priority Data

Dec. 8, 1981 [JP] Japan ..... 56-196254

[51] Int. Cl.[3] ..... D05B 97/02; D05B 57/12; D05B 75/04

[52] U.S. Cl. ..... 112/169; 112/193; 112/245

[58] Field of Search ..... 112/169, 192, 193, 303, 112/245

[56] References Cited

U.S. PATENT DOCUMENTS

| | | | |
|---|---|---|---|
| 1,009,065 | 11/1911 | Hahn et al. | 112/169 X |
| 2,479,017 | 8/1949 | Merson et al. | 112/169 |
| 2,594,534 | 4/1952 | Bell | 112/169 |
| 2,604,861 | 7/1952 | Merson et al. | 112/245 X |
| 3,168,849 | 2/1965 | Zilg et al. | 112/169 X |

FOREIGN PATENT DOCUMENTS

| | | | |
|---|---|---|---|
| 297534 | 4/1917 | Fed. Rep. of Germany | 112/169 |
| 314242 | 9/1919 | Fed. Rep. of Germany | 112/169 |
| 628778 | 4/1936 | Fed. Rep. of Germany | 112/169 |
| 1164030 | 5/1958 | France | 112/169 |
| 1200713 | 7/1959 | France | 112/169 |
| 2157 | 2/1889 | Sweden | 112/169 |

*Primary Examiner*—Wm. Carter Reynolds

*Attorney, Agent, or Firm*—Robert E. Burns; Emmanuel J. Lobato; Bruce L. Adams

[57] ABSTRACT

A lock stitch type hand sewing machine comprises a bed and a needle arm pivoted mutually at one end on the bed. The bed is provided with a shuttle and the needle arm is provided with a needle on its free end. The operation of this sewing machine is effected by gripping the bed and the needle arm with one hand to rock them, and according to this operation, the needle and the shuttle are relatively moved to form lock stitch.

8 Claims, 18 Drawing Figures

LOCK STITCH TYPE HAND SEWING MACHINE

BACKGROUND OF THE INVENTION

This invention relates to a sewing machine, particularly to a lock stitch type hand sewing machine operated by gripping with one hand.

In a known lock stitch type hand sewing machine, as shown in U.S. Pat. No. 2,594,534, a shuttle, a bobbin, a driving member, and a work feed dog are incorporated within a main body, and a needle arm for supporting a needle, a thread take-up arm, and a pliers type handle are respectively connected with the main body, thus by the operation of the handle, the respective members are connectively worked. Therefor, complicated cam mechanism and transmission means of gear mechanism must be incorporated within the main body thus making whole hand sewing machine large size and heavy, so that the operation of sewing machine by gripping with one hand is not easy, the construction is complicated, the assembly thereof is troublesome and the manufacturing cost becomes higher, etc. thus leading to disadvantages as a hand sewing machine.

The object of this invention is to provide a hand sewing machine having no such disadvantages, and according to this machine it is characterized that the shape thereof is compact, having a good appearance, light in weight, easy to operate by gripping with one hand, simple in structure, and cost of production thereof is reduced.

SUMMARY OF THE INVENTION

To attain above mentioned object, the lock stitch type hand sewing machine of the present invention is provided with a bed and a needle arm pivoted mutually at one end thereof on the bed, and these two members may be gripped for relative rocking. The arm is fixed with a needle for supplying of upper thread on another end of the arm. The bed is incorporated therein with a shuttle to interlock the upper thread round the lower thread and a driver to rock the shuttle. And there is provided with a transmitting means to drive the driver in accordance with the relative rocking motion between the arm and the bed. When this arm and bed are rocked, the needle will form a lock stitch together with the shuttle. This sewing machine is further provided with a feed dog and a thread take-up arm, and these members will work to feed work and to tighten the upper thread, following to the relative rocking between the arm and the bed.

These objects together with others as well as the feature of this invention will become clear to those skilled in the art from the following description of embodiments with reference to the accompanying drawings.

DESCRIPTION OF THE PREFERRED EMBODIMENTS

Figure 1:
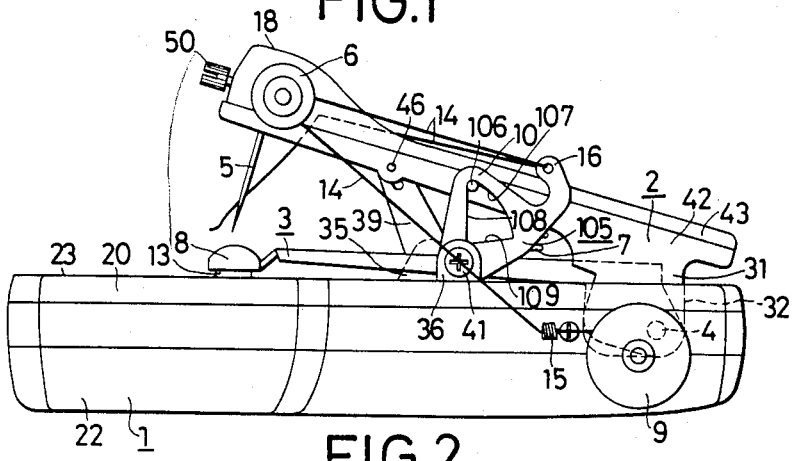
FIG. 1 is an elevational view of a hand sewing machine according to this invention.
Figure 2:
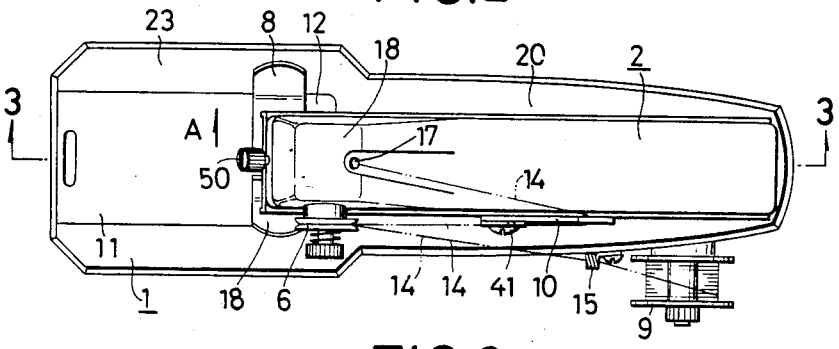
FIG. 2 is a plan view of this sewing machine.

In FIG. 1 and FIG. 2, there are shown outlines of external appearance of a lock stitch type hand sewing machine according to this invention. A bed (1), a needle arm (2) and a work presser arm (3) are pivotally connected at a common point (4). The arm (2) is fitted with a needle (5) and a thread tensioning disc (6) at its free end, and is always urged by a spring (7) away from the bed (1) in opening direction (upward direction). The arm (3) is formed as a work presser foot (8) at its free end, and is always urged by a spring (to be described later) in a direction toward the bed. Thus the work presser foot (8) presses the work against the bed. The bed (1) is larger than the arm (2) and the arm (3) in the point of breadth, length and height and has a hollow interior in which is incorporated a bobbin for a lower thread, a shuttle, a driver, a feed dog, transmission means for transmitting the power of the needle arm to the driver and the feed dog (to be described later). The bed (1) is further respectively provided with a bobbin (9) for upper thread at its rear portion, and a rockable thread take-up arm (10) at its intermediate portion and a shuttle race slide (11), a needle plate (12) and a feed dog (13) at its front portion.

The upper thread (14) passes from above to below through a hole (17) by way of the thread guide (15), a thread tensioning disc (6) and a hole (16) of the thread take-up arm (10) from the bobbin (9), thus suspended to reach a hole of the needle (5), Under this condition, the bed (1) is supported by the fingers from a fore-finger to a little finger and a raised flat periphery of a tip (18) of the arm is lightly pressed by a thumb, thus the hand sewing machine is gripped by one hand. By pressing the arm (2) with the thumb repeatedly, the needle (5) moves up and down as well as the feed dog (13) moves forward and backward and up and down, and the thread take-up arm (10) rocks around a pin (41) in front and in rear to form lock stitch successively as well as the work feeding in the direction of an arrow (A), the feed of upper thread and the tightening of thread are connectively effected.

Figure 3:
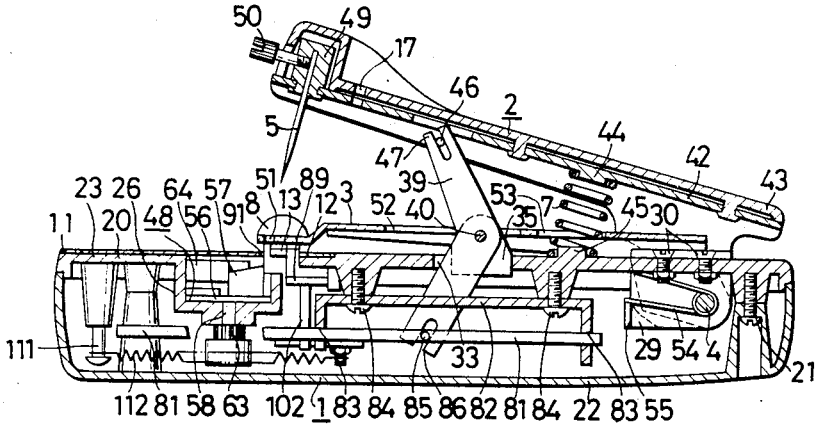
FIG. 3 is a sectional view along 3—3 line of FIG. 2.
Figure 5:
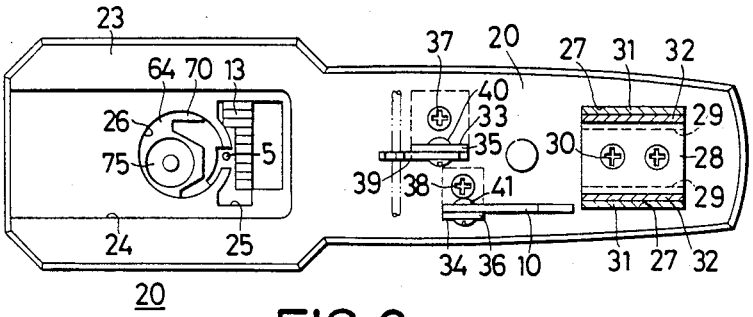
FIG. 5 is a plan view of this sewing machine, in which needle arm, work presser arm, shuttle race slide and needle plate are eliminated.
Figure 6:
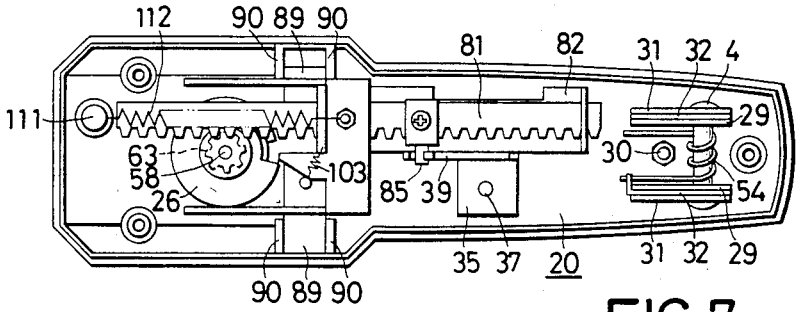
FIG. 6 is a bottom view of this sewing machine, in which a cover is eliminated.
Figure 4:
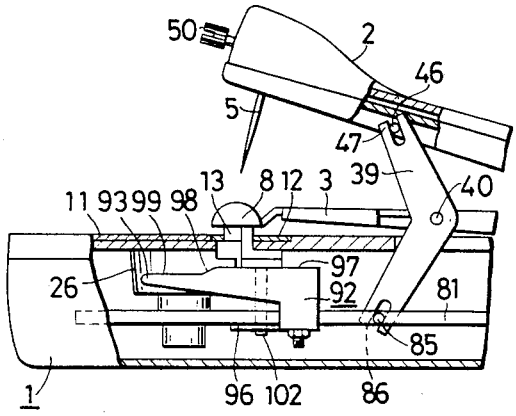
FIG. 4 is an elevational view of this sewing machine, in which a part of main body and of cover being cut away.
Figure 9:
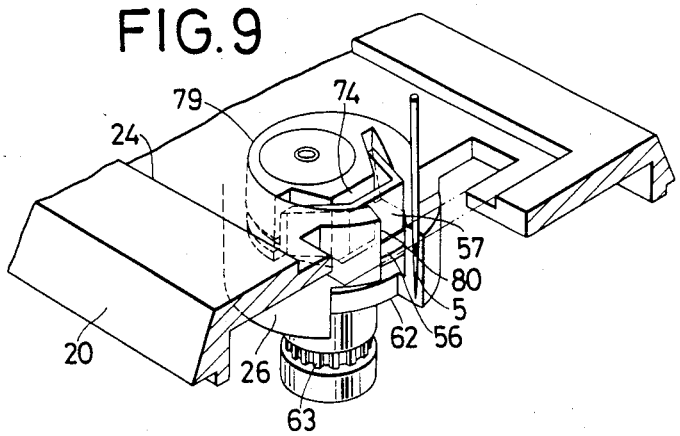
FIG. 9 is an enlarged perspective view showing the assembly relating to bed frame, shuttle race body, shuttle, driver, pinion and needle, mainly of this sewing machine.

Upon further detailed explanation, the bed (1) is formed by a bed frame (20) and a cover (22) joined by a set screw (21) on its underface (FIG. 3), each preferably formed by synthetic resin, so that it is light and gives no cold feeling, but easy coloring, also the production cost may be reduced. The bed frame (20) has a flat upper face and a rectangular dent (24) is formed on a wide frame (23) in the tip portion (FIG. 5, FIG. 9). On the surface of the dent (24), there are an elongated opening (25) for the feed dog (13) and a shuttle race body (26) (FIG. 5), which body (26) is extending to the back side of the bed frame (20) (FIG. 3, FIG. 6). The bed frame (20) is further formed with two elongated openings (27) mutually in parallel at its rear end, and both legs (29) of a channel shaped bracket (28) are passed through the elongated opening (27) from above to below and fixed by screws (30). Similarly, two legs (31) of the arm (2) and two legs (32) of the arm (3) are passed through the elongated opening (27) from above to below and these legs are pivoted to legs (29) of the bracket (28) by means of the pin (4) (FIG. 3, FIG. 5, FIG. 6).

In the bed frame (20), elongated openings (33, 34) are also formed at a central position and an eccentric position of its intermediate portion (FIG. 5). In these elongated openings, upright portions of each L-shaped brackets (35, 36) are passed through from below to above and each flat portion is fixed to the back side of the bed frame (20) by means of screws (37, 38) (FIG. 5). An interlocking rocking lever (39) is pivoted to a bracket (35) by means of a pin (40) and its lower end passes through an elongated opening (33) and extends to the back side of the bed frame (20). The thread take-up arm (10) is pivoted to the bracket (36) by means of a pin (41) FIGS. 1, 3 and 5.

The arm (2) is made of a metallic frame (42) connected with a cover (43) which is preferably formed from synthetic resin (FIG. 3) and by means of this cover, similar effect to said cover (22) may be obtained. The frame (42) is formed into the two legs (31) for pivoting at its rear end, and both ends of a compression spring (7) are fitted to an intermediate boss (44) of the frame (42) of the arm (2) and an intermediate boss (45) of the bed frame (20) to exert on the frame (42) a force in the direction of opening the same (FIG. 3). The frame (42) further has a pin (46) rising up at an intermediate position between the spring (7) and the needle (5), the pin (46) is fitted to a fork portion (47) of the rocking lever (39) to connect the frame (42) with the rocking lever (39), which is then rocked according to the rocking of the frame (42), thus a driver (48) and the feed dog (13) are driven as will be mentioned later (FIG. 3). The frame (42) is also provided with a tip a member (49) to which tip a needle (5) is to be attached and the needle is fixed by a screw (50) engaged with the tip member (FIG. 3).

The work presser arm (3) is also preferably formed of metal similar to the frame (42). The arm (3) is respectively provided with a hole (51) for passing a needle (5) at the presser foot (8) of its tip and a hole (52) for passing the rocking arm (39) and a hole (53) for passing the spring (7) at the intermediate portion (FIG. 3). And, the arm (3) is energized in the direction of the bed by hanging one end of a torsion spring (54) wound around the pin (4) on a lug (55) of the leg (29) and another end on the back face of the bed frame (20) (FIG. 3, FIG. 6).

Figure 8:
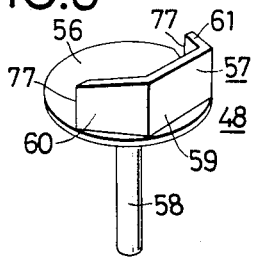
FIG. 8 is an enlarged perspective view of a driver of this sewing machine.

The driver (48) has a disc portion, a shuttle retaining wall (57) rising over about semicircle of the disc portion (56), and a shaft (58) extending downward from the back face of the disc portion. The retaining wall (57) is formed of a central wall (59) and walls (60, 61) extending in the direction opened about 120° from both ends of the wall (59) (FIG. 8). When this driver (48) is incorporated within the shuttle race body, the disc portion (56) is supported by a bottom wall (62) of the shuttle race body (26) and the shaft (58) will pass through the hole of the bottom wall to extend thereunder. A pinion (63) is fixed to the shaft (58) and the driver (48) can rotate in both directions with the shaft (FIG. 3, FIG. 9).

Figure 7:
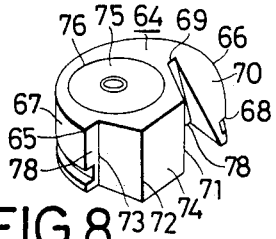
FIG. 7 is an enlarged perspective view of a shuttle of this sewing machine.

The shuttle (64) has a profile mainly formed of a circular wall (67) which is extending approximately in semicircle from a point (65) to a point (66), a hook portion (70) which is extending from the point (66) to a point (69) via a point (68), and a square shaped wall (74) which is extending from the point (69) to a point (73) via points (71, 72), and a recess (76) is formed within the shuttle to incorporate a bobbin (75) for supplying of lower thread (FIG. 7). When this shuttle (64) is incorporated within the shuttle race body, the wall (74) of the shuttle and the shuttle retaining wall (57) of the driver will face each other with some gap and both ends (77) of the retaining wall (57) will engage with shoulder portions (78), thus preventing the relative rotation to the driver (48). The circular wall (67) of the shuttle (64) further contacts with a circular wall (79) of the shuttle race body (26), so that the shuttle is rotated by the driver (48) within the shuttle race body (26) (FIG. 9).

The shuttle race body (26) is integrated with the bed frame (20) and an opening (80) for passing of the needle (5) and thread is formed at a portion of the wall (79) of the shuttle race body (FIG. 9).

As a means for transmitting the driving power due to the rocking of the arm (2) to the driver (48), a rack (81) exists between the rocking lever (39) and the pinion (63), as shown in FIG. 3 and FIG. 6. The rack (81) is supported by the bracket in such a state that it passes through a guide opening (83) of a channel shaped bracket (82), which is fixed to the back side of the bed frame (20) by screws (84). On end of the rack (81) extends to a position over the pinion (63) and mutually engages with the pinion. A pin (85) projecting from the rack (81) is fitted to a fork portion (86) of the lever (39). According to the rocking of the arm (2), the rocking arm (39) rocks around the pin (40). According to the rocking of the rocking lever (39), the rack (81) will reciprocate in a straight line to rotate the pinion (63) reciprocately and to drive the driver (48). And, when a tension spring (112) is provided between the rack (81) and a lug (111) projective from the bed frame (20), the reciprocating motion of the rack will be more smoothly effected.

Figure 10:
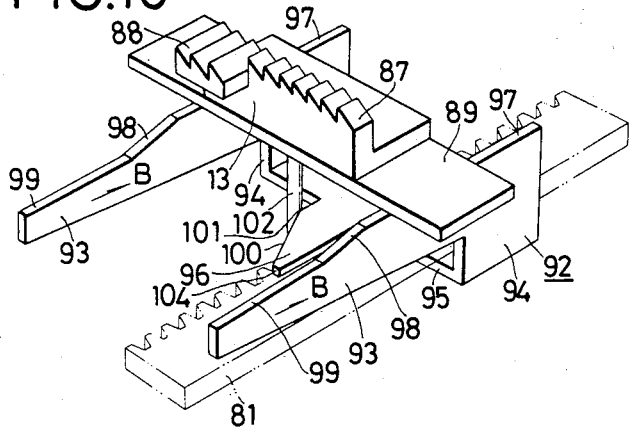
FIG. 10 is an enlarged perspective view of work feeding mechanism of this sewing machine.

As the work feeding means, as best shown in FIG. 10, the feed dog (13) has narrower breadth of latter half portion (87) than the breadth of former half portion (88) and is fixed to a long and narrow rectangular plate shaped carrier plate (89), without disturbing up and down motion of the needle (5). The carrier plate (89) will be guided in the direction of work feeding and in the opposite direction by means of a guide wall (90) projecting from the bed frame (FIG. 6). Following the carrier plate (89), the feed dog (13) will move back and forth along the elongated opening (25) of the bed frame (20) and the elongated opening (91) of the needle plate (12) (FIG. 3, FIG. 5). The carrier plate (89) is supported by a feed member (92), which is fixed to the rack (81). According to the reciprocating motion of the rack, the feed member (92) will give back and forth motion and up and down motion, and consequently the feed dog (13) will effect a work feeding motion.

Concretely speaking, in particular as shown in FIG. 10, the feed member (92) comprises first cams (93, 93) of elongated plate shape, mutually extending in parallel, a plate-shaped upright portion (94) extending approximately in right angle from one end of each cam, a connecting portion (95) of elongated plate shape, mutually connecting each end of said upright portion, and a second cam (96) of tong shaped extending from the side of the connecting portion in the direction parallel to the cam (93). The cams (93, 93) have horizontal cam surfaces (97) on upper side thereof, cam surfaces (98) extending obliquely downward from the cam surfaces, and cam surfaces (99) extending horizontally from the cam surfaces. When the cam surfaces (97) are supporting the carrier plate (89), the feed dog (13) exists at the highest position. According to the movement of the cams (93) in the direction of arrows (B), the carrier plate (89) is lowered along the cam surfaces (98) and supported by the cam surfaces (99) at the lowest position. On the contrary, when the cams (93) are moved in the opposite direction to the arrows (B) under the state of the carrier plate (89) being supported on the cam surfaces (99), the carrier plate will be raised from the lowest position to the highest position. Thus the cams (93) will give the up and down motion to the feed dog (13). The cam (96) has an inclined cam surface (100). When this cam surface (100) engages at a point (101) with a pin (102) which is integral with the carrier plate (89), this carrier plate exists at advanced position. When the cam (96) moves in the direction of arrows (B), the pin (102) will relatively move to a position (104) along the cam surface (100) by the tension of a spring (103) (FIG. 6) to give the feed dog (13) the backward motion. On the contrary, when the cam (96) moves in the opposite direction to the arrows (B), the pin (102) will move from a position (104) of the cam surface (100) to give the feed dog the forward motion. The up and down motion and the forward and backward motion of the carrier plate (89) due to these cams (93) and (96) are composed to make the feed dog (13) to effect upward, forward, downward and backward motion.

The thread take-up arm (10) has follower means as shown as a fan-shaped hole (105), which is passed through by driver means shown as a pin (106) on the frame (42) of the first arm (2) (FIG. 1). As shown in FIG. 1, under the state that the arm (2) is opened as maximum, the pin (106) engages with a corner portion where an arcuate portion (107) of the opening (105) and a straight line portion (108) intersect to keep the thread take-up arm (10) at a backward tilted position (thread tensioning position). When the arm (2) is pressed in, the pin (106) makes the thread take-up arm (10) rotate to the backward tilted position (thread tensioning position) around the pin (41) while giving counter clockwise force to the straight line portion (108), thus reaching the corner portion of an intersecting point of the straight line portions (108, 109). As the arm (2) opens, the pin (106) moves from the intersecting point of the straight line portions (108, 109) to the intersecting point of the straight line portion (109) and the arcuate portion (107). While the pin (106) will slide along the straight line portion (109), but the thread take-up arm (10) is not given backward rotational force to say nothing of forward rotational force. Thus the forward tilted posture is kept. When the arm (2) is opened further, the pin (106) moves from the intersecting point of the straight line portion (109) and the arcuate portion (107) to the intersecting point of the arcuate portion (107) and the straight line portion (108). While the pin (106) gives force to the arcuate portion (107) to rotate the thread take-up arm from the forward tilted position to the backward tilted position.

In the next place, seaming operation of a sewing machine according to this invention will be explained as a whole.

When the arm (2) exists at full opened position (point E in FIG. 12), the needle (5) exists at higher dead point, the tip of hook portion (70) of the shuttle (64) exists before about 60° from the position of the needle (5) as shown in FIG. 11(A), the feed dog (13) exists at raised forward position, and the thread take-up arm (10) exists at the backward tilted position respectively.

When the arm (2) is closed (point G in FIG. 12), the needle (5) reaches the lower dead point from the upper dead point, the shuttle (64) rotates about 315° in the counter clockwise direction (the direction of arrow C) from the state of FIG. 11(A) to reach a position of FIG. 11(B). While the tip of the hook (70) gets away from the position of the needle, via the most remote position and again passes through the nearest position and stops at some distance, (from point E to point G) and the feed dog (13) will retreat while lowering (point F in FIG. 12), and the thread take-up arm (10) is tilted forward to supply the upper thread (14).

Figure 11:
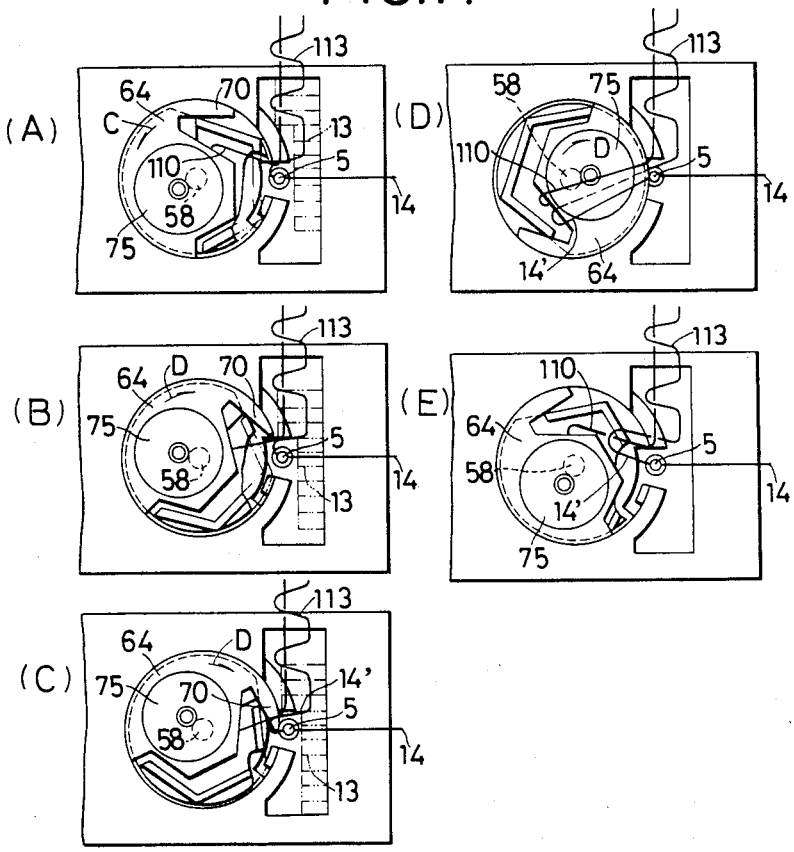
FIG. 11(A) to (E) are explanatory schematic views illustrating the formation of lock stitch by means of this sewing machine.
Figure 12:
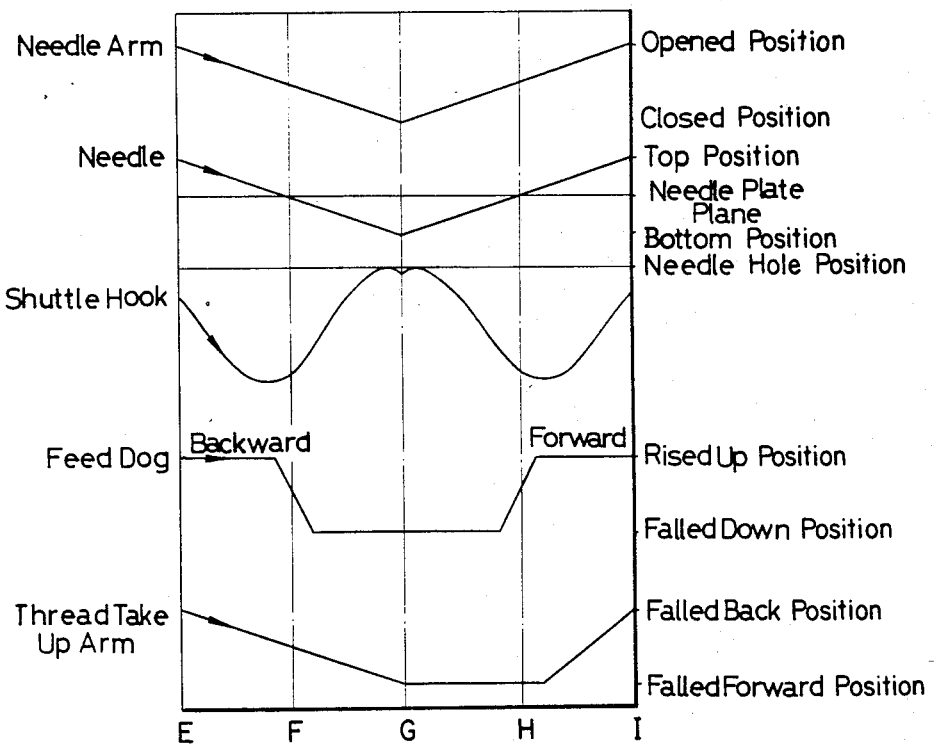
FIG. 12 is a diagram illustrating the overall movement of this sewing machine.

When the arm is opened a little (from point G to a point slightly over this point in FIG. 12), the needle (5) is raised a little from the lower dead point to the upper dead point, while the shuttle (64) rotates in the direction of arrow (D) from the condition of FIG. 11(B) to that of FIG. 11 (C) and the hook portion (70) will catch a loop (14') of the upper thread (14) at the nearest point (a point slightly over the point G in FIG. 12) to the needle (5). The feed dog (13) is now stopped at the lower position and the thread take-up arm (10) is stopped at the forward tilted position respectively.

When the arm (2) is further kept opened (from point G to point H in FIG. 12), the needle (5) continues to rise, and the shuttle (64) further rotates from FIG. 11(C) in the direction of the arrow D, and the hook (70) will get away from the needle (5) while pulling the loop (14') of the upper thread (FIG. 11), thus the body of the shuttle (64) is made to pass through the loop such that upper and lower faces of said body are wound round. During such a state, the feed dog (13) and the thread take-up arm (10) are both stopped at lowered retreat position and forward tilted position.

As the arm (2) is further opened to reach the maximum opened position (from point H to point I in FIG. 12), the needle (5) will pass through the needle plate (12) to reach the upper dead point. The shuttle (64) will further rotate in the direction of arrow (D) from the state of FIG. 11(D). When the needle (5) passes through the needle plate (12) from below to above, the loop (14') of the upper thread will be able to slip out of the shuttle (64). At this moment, the feed dog (13) will be raised and advanced as well as the thread take-up arm (10) is tilted backward and work feeding and thread tensioning action are effected. The loop (14') will interlock the lower thread (110) fed from the bobbin (75) (FIG. 11(D) to form seam (113) (FIG. 11(E)).

In this way, according to this invention, the bed (1) and the arm (2) are gripped with one hand to rock the arm (2), and by such simple operation, the seam of upper and lower threads becomes a lock stitch hard to get loose, and very convenient, thus a nice hand sewing machine of simple construction, light weight and compact, may be obtained.

Figure 13:
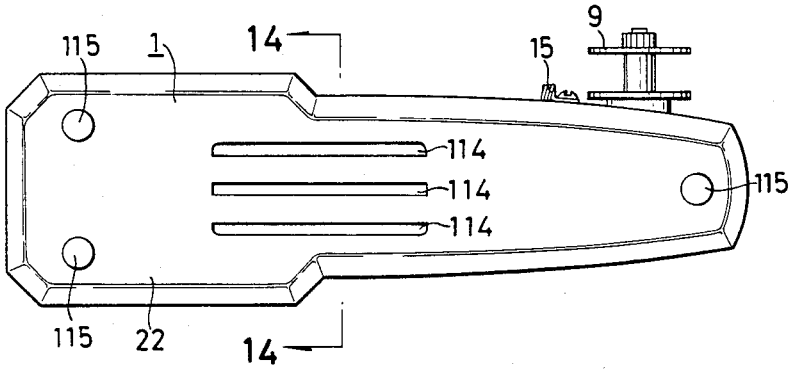
FIG. 13 is a bottom view, showing another embodiment of this sewing machine.
Figure 14:
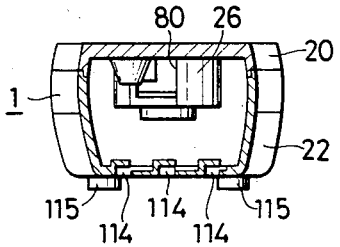
FIG. 14 is a sectional view along 14—14 line of FIG. 13.

And, as shown in FIG. 13, the bottom face of the cover (22) may be provided with elongated openings (114), which may prevent the outbreak or rasping low sound. And the bottom face of the cover (22) may be provided with nonskid substance (115) such as rubber, by means of which the sewing machine may be operated under the state that the sewing machine is put on a table and the like.

This invention is not limited to the above mentioned embodiments, which may be changed in several forms within the range of the following claims.

What is claimed is:

1. A lock stitch hand sewing machine comprising a bed, a needle arm pivoted at one end of said bed and manually movable toward said bed from an open position at an acute angle to said bed to a closed position, spring means biasing said needle arm toward open position, a needle plate on said bed having a needle opening therein, a needle carried by said needle arm and movable through said opening in said needle plate when said needle arm is moved from open to closed position, means for supplying an upper thread to said needle, a bobbin on said bed below said needle plate for supplying a lower thread, a shuttle carrying said bobbin, driving means for moving said shuttle to interlock said lower thread with said upper thread when said needle is moved through said opening in the needle plate, and transmitting means for activating said driving means, including a rocking lever pivoted at an intermediate point to said bed and having one end connected with said needle arm and the other end extending within said bed, a rack reciprocable in said bed and connected with said other end of said lever so as to be reciprocated thereby and a pinion engaged with said rack and fixed on said driving means, whereby rocking motion of said needle arm by manual operation is transmitted to said driving means to move said shuttle to interlock said lower thread with said upper thread.

2. A lock stitch hand sewing machine according to claim 1, further comprising a work presser arm pivotally connected to said bed and disposed between said bed and said needle arm and spring means for biasing said work presser arm toward said bed.

3. A lock stitch hand sewing machine according to claim 2, further comprising a feed dog incorporated in said bed and means for moving said feed dog comprising first cam means for moving said feed dog up and down and second cam means for moving said feed dog forward and backward, both of said cam means being actuated by movement of said rack.

4. A lock stitch hand sewing machine according to claim 1, further comprising take-up means for said upper thread, said take-up means comprising a take-up arm pivotally mounted on said bed and cam follower means on said take-up arm cooperating with driver means on said needle arm for actuating said take-up arm by movement of said needle arm.

5. A lock stitch hand sewing machine according to claim 1, in which said bed is provided with elongate openings for preventing a rasping sound upon operation of said machine.

6. A lock stitch hand sewing machine according to claim 1, further comprising non-skid material on a lower face of said bed.

7. A lock stitch hand sewing machine according to claim 1, in which said shuttle driving means comprises a shaft on which said pinion is fixed, a disc portion on said shaft and perpendicular thereto and a retaining wall projecting from said disc and comprising a central wall portion and two end wall portions extending obliquely from said central wall portion.

8. A lock stitch hand sewing machine according to claim 7, in which said shuttle comprises an approximately semicircular wall, a hook portion at one end of said wall and a square shaped wall opposite said approximately semicircular wall, said walls defining a recess to receive a bobbin.

* * * * *